US008915976B1

(12) United States Patent
Lowery

(10) Patent No.: US 8,915,976 B1
(45) Date of Patent: Dec. 23, 2014

(54) FUEL ADDITIVE

(71) Applicant: Christopher Haydn Lowery, Fall River Mills, CA (US)

(72) Inventor: Christopher Haydn Lowery, Fall River Mills, CA (US)

( * ) Notice: Subject to any disclaimer, the term of this patent is extended or adjusted under 35 U.S.C. 154(b) by 0 days.

(21) Appl. No.: 14/093,818

(22) Filed: Dec. 2, 2013

(51) Int. Cl.
*C10L 1/18* (2006.01)
*C10L 1/26* (2006.01)
*C10L 1/185* (2006.01)
*C10L 1/222* (2006.01)

(52) U.S. Cl.
CPC ..... *C10L 1/2641* (2013.01); *C10L 1/1852* (2013.01); *C10L 1/2222* (2013.01)
USPC ..... 44/382; 44/434; 44/443; 44/444

(58) Field of Classification Search
USPC ..... 44/382, 434, 443
See application file for complete search history.

(56) References Cited

U.S. PATENT DOCUMENTS

| | | | | | |
|---|---|---|---|---|---|
| 2,221,839 | A * | 11/1940 | Lipkin | ..... | 44/443 |
| 2,774,656 | A * | 12/1956 | Newman et al. | ..... | 44/443 |
| 2,786,745 | A * | 3/1957 | Stayner et al. | ..... | 44/443 |
| 3,115,465 | A * | 12/1963 | Knapp et al. | ..... | 508/442 |
| 5,344,468 | A * | 9/1994 | Hanlon et al. | ..... | 44/379 |
| 5,425,790 | A * | 6/1995 | Liotta et al. | ..... | 44/443 |
| 6,217,624 | B1 * | 4/2001 | Morris et al. | ..... | 44/434 |
| 6,458,172 | B1 * | 10/2002 | Macduff et al. | ..... | 44/348 |

* cited by examiner

*Primary Examiner* — Cephia D Toomer
(74) *Attorney, Agent, or Firm* — Plager Schack LLP

(57) ABSTRACT

Fuel efficiency can be increased in a diesel engine by adding a diesel fuel additive mixture. The diesel engine fuel additive mixture is made up of the following elements: tricresyl phosphate (TCP) and a Polyetheramine (PEA) dissolved in a Glycol ether. Adding one ounce of the diesel engine fuel additive mixture per five U.S. gallons of diesel fuel can increase miles per gallon and hours of operating time while reducing the emission of nitrous oxides, sulfur, and other pollutants.

20 Claims, 3 Drawing Sheets

Formula A

Formula B

Formula A

Formula B

FUEL ADDITIVE

BACKGROUND

The embodiments herein relate generally to compositions of matter configured to increase efficiency in diesel engines.

Engine efficiency is a panacea of mechanical and chemical engineering. A more efficient engine will produce more work at a higher torque while consuming less fuel than an engine which is less efficient. Improved efficiency in gasoline engines have been developed in recent years, but improved efficiency in diesel engines has been panned.

Diesel fuel has a higher specific energy 130,000 BTU (British Thermal Units) per United States gallon (BTU/USG) content than gasoline, which has 115,000 BTU/USG, and so less fuel is required to be carried for a specific work output. Diesel fuel is safer to handle and store, since it has a high flash point, between 100 and 130 degrees Fahrenheit (which is 37.8 to 54.4 degrees Centigrade), whereas gasoline has a flash point of −45 degrees Fahrenheit (which is −42.8 degrees Centigrade) making gasoline considerably more flammable and hazardous to handle and store.

Various government agencies have required less carbon monoxide, total hydrocarbons and NOx (oxides of nitrogen) emissions from heavy-duty diesel engines during certain driving modes. In order to meet NOx limits, urea injection into the exhaust stream ahead of a new extra catalytic converter was introduced. Trucks then had to carry a solution of urea (NH2)2CO in water, along with the monitoring equipment for tank level. The effect of an aqueous urea solution in the hot exhaust stream is to chemically reduce the NOx to harmless nitrogen gas and water exiting the extra catalytic converter.

These tightening emission requirements meant that diesel engine designers had to make their engines more efficient and part of that requires that the exhaust be cleaner. In order to do this, combustion chemistry became a far more precisely controlled process, with computer controlled timing, mass air flow sensors, precision individual cylinder fuel injectors, exhaust gas recirculation and turbo chargers. With a more precisely controlled process, any deposits in the inlet manifold area and in the injectors or in the combustion chamber would degrade the performance of the engine, since any degradation increases fuel consumption and tail pipe emissions.

Embodiments of the disclosed invention take this problem from an entirely new angle focusing on efficiency in combustion chemistry itself without the need for changing hardware within the engine.

SUMMARY

This process increases the thermodynamic efficiency of a diesel engine running on diesel fuel. The process involves adding to the diesel fuel a diesel engine fuel additive mixture further comprising: 2 to 20 percent by volume tricresyl phosphate; 5 to 70 percent by volume polyetheramine; and at least one glycol ether. The polyetheramine comprises a member selected from a group consisting of:

Formula A

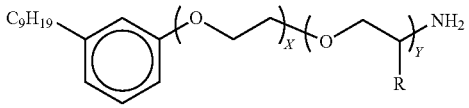

-continued

Formula B

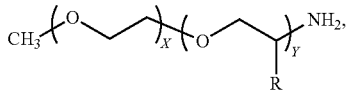

Here R is selected from the group consisting of H and $CH_3$. Y is in a range of 2 to 30 and x is 0 or in a range of 2 to 30 when R is $CH_3$, and wherein x+y is in a range of 2 to 30 when R is H.

In some embodiments, R is CH3 and y is in a range of 2 to 30. In other embodiments, R is H and x+y is in a range of 2 to 30. In other embodiments, R is CH3, x is in a range of 2 to 30, and y is in a range of 2 to 30.

The glycol ether can have a flash point between 141° Fahrenheit and 200° Fahrenheit. In some embodiments, the glycol ether comprises 2-butoxyethanol. In other embodiments, the glycol ether comprises a glycol ether or mixture of glycol ether selected from the group consisting of 2-methoxyethanol, 2-ethoxyethanol, 2-propoxyethanol, 2-isopropoxyethanol, 2-butoxyethanol, 2-phenoxyethanol, 2-benzyloxyethanol, 2-(2-methoxyethoxy)ethanol, methyl carbitol, 2-(2-ethoxyethoxy)ethanol, carbitol cellosolve, 2-butoxyethoxyethanol, dimethoxyethane, diethoxyethane, and dibutoxyethane.

In some embodiments, the polyetheramine comprises a phenyl group containing an amine substituent, R is CH3, x is in a range of 2 to 30, and y is in a range of 2 to 30. The polyetheramine can have a molecular weight in a range of 800 to 2,500.

In some embodiments the diesel engine fuel additive mixture further comprises 0.5 percent by weight or less of a dye. The diesel engine fuel additive mixture can further comprise less than 0.5 percent by weight of an antioxidant. The diesel engine fuel additive mixture can further comprise less than 0.15 percent by weight odorizing additive.

In some embodiments, the diesel engine fuel additive mixture further comprises up to 2 percent by volume of a solvent having a flash point above 141° Fahrenheit for dissolving at least one member selected from the group consisting of an odorizing additive and an antioxidant additive. The solvent can be isopropanol, dichlorobenzene, or a combination thereof. Tricresyl phosphate can include an ortho isomer content of below 3.0 percent by weight.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
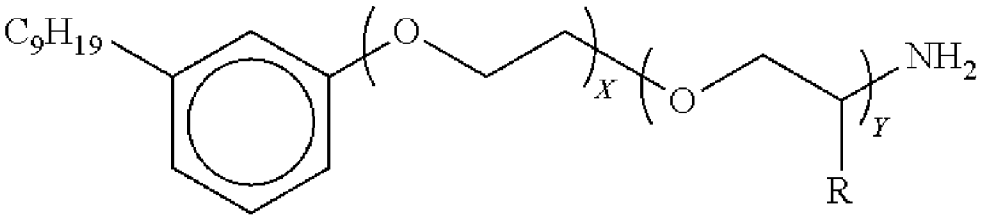
FIG. 1 shows type A and B are Polyetheramines (PEA) suitable for use in the claimed mixture.
Figure 1:
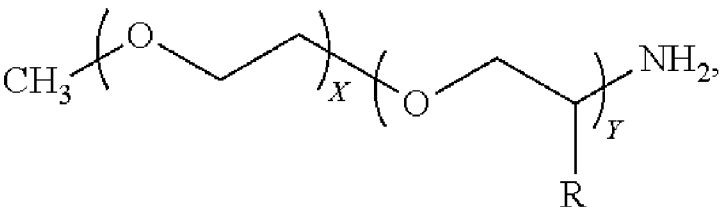

By way of example, and referring to FIG. 1, one embodiment of the present system comprises a composition of matter disclosed in U.S. Pat. No. 8,016,897 (the '897 patent), which is briefly summarized below:

The diesel engine fuel additive mixture is made up of the following elements tricresyl phosphate (TCP), a Polyetheramine (PEA) as described in FIG. 1, and selected the group consisting of the following Formula A and Formula B dissolved in a Glycol ether. The concentration range of PEA is 5 to 70 percent by volume of the overall additive mixture. The range of TCP is 2 to 20 percent by volume in the additive mixture. The remaining weight is made up with at least one glycol ether.

Formula A

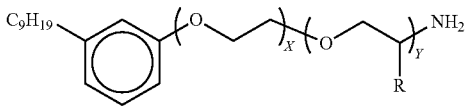

Formula B

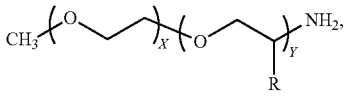

These elements are dissolved together to form a clear solution. The TCP and the PEA are added to the glycol ether. The proportions of TCP, PEA and glycol ether are limited by their mutual solubility's of one in the other. The purity of the TCP should not be less than a Technical Grade, since materials other than the chemical description can prevent the formation of a clear solution. The polyetheramine is preferably, but not limited to, a primary amine. The primary amine is ethoxylated and propoxylated such that the molecular weight is in the range of 1,000 to 1,500, as shown in FIG. 1. The effectiveness of the PEA in this described mixture is limited by the solubility of the material in the other two components. The PEA used must also meet practical considerations, for example it must not precipitate from the mixture at extremes of use temperatures, nor must it react chemically with the other two components. Typical use temperatures would range from −20 degrees C. to 120 degrees C.

R is selected from H and CH3. The polyetheramine may be comprised of a linear alkyl chain in which there are propylene oxide moieties in a range of 2 to 30, terminating in a single amine group, i.e., R is CH3, y is in a range of 2 to 30, and x is 0. The polyetheramine may be comprised of a linear alkyl chain in which there are ethylene oxide moieties in a range of 2 to 30, terminating in a single amine group, i.e., R is H, x+y is in a range of 2 to 30. The polyetheramine may contain both ethylene oxide and propylene oxide moieties each in the range of 2 to 30, i.e., R is CH3, x is in a range of 2 to 30, and y is in a range of 2 to 30. Of course, an amine is not required and an amine substituent works as well.

The Glycol ether can be Ethylene glycol monomethyl ether (2-methoxyethanol, CH3OCH2CH2OH); Ethylene glycol monoethyl ether (2-ethoxyethanol, CH3CH2OCH2CH2OH); Ethylene glycol monopropyl ether (2-propoxyethanol, CH3CH2CH2OCH2CH2OH); Ethylene glycol monoisopropyl ether (2-isopropoxyethanol, (CH3)2CHOCH2CH2OH); Ethylene glycol monobutyl ether (2-butoxyethanol, CH3CH2CH2CH2OCH2CH2OH); Ethylene glycol monophenyl ether (2-phenoxyethanol, C6H5OCH2CH2OH); Ethylene glycol monobenzyl ether (2-benzyloxyethanol, C6H5CH2OCH2CH2OH); Diethylene glycol monomethyl ether (2-(2-methoxyethoxy)ethanol methyl carbitol, (CH3OCH2CH2OCH2CH2OH); Diethylene glycol monoethyl ether (2-(2-ethoxyethoxy)ethanol carbitol cellosolve, (CH3 CH2OCH2CH2OCH2CH2OH); Diethylene glycol mono-n-butyl ether (2-butoxyethoxy)ethanol, CH3CH2CH2CH2OCH2CH2OCH2CH2OH); Dialkyl ethers such as Ethylene glycol dimethyl ether (dimethoxyethane, CH3OCH2CH2OCH3); Ethylene glycol diethyl ether (diethoxyethane, CH3CH2OCH2CH2OCH2CH3); and Ethylene glycol dibutyl ether (dibutoxyethane, CH3CH2CH2CH2OCH2CH2OCH2CH2CH2CH3).

The preferred mixture consists of the following percentages:

| Compound | Percentage by Volume |
|---|---|
| 2-Butoxy Ethanol | 83.0% |
| Polyetheramine | 10.0% |
| Tricresyl phosphate | 7.0% |

The mixture described is soluble in all proportions in diesel fuel, in both summer and winter formula. It is also soluble in all proportions in red dyed tax free diesel, used by off-road vehicles such as tractors and earth moving equipment. The preferred addition rate is 1 ounce per 5 U.S. gallons of diesel fuel which is 1.6 ml/liter.

A person skilled in the art of compounding these formulations would not, in the ordinary way of development, have put together this formulation specifically for diesel engines, since diesel additive formulations are generally completely different. For example, solvent naphtha (for example CAS 64741-66-8) or a hydro-treated oil (for example CAS 72623-87-1) would be used as the carrier solvent and thus they would not achieve the anti-icing properties of the invention described here. Using such solvents would also make the flash point too dangerous and much too low for shipment purposes for which this invention was designed. Solvent naphtha has a flash point typically of −21 degrees Centigrade, although a high flash point solvent (that which has a flash point greater than 62 degrees Centigrade) naphtha is available.

Similarly, TCP would not in the normal way be considered as an ingredient in a diesel fuel additive. Only in the '698 patent was it included, and that was for the specific purpose of chemically reacting with lead in leaded aviation fuel to produce a high melting point lead phosphate which would be expelled in the exhaust gasses. Lead unreacted in this way can form lead oxide deposits on spark plugs, short out the points and cause misfiring and join with carbon deposits in the combustion chamber which are exceedingly hard and difficult to remove. The lead oxide deposits on the spark plug electrodes prevents a proper spark being generated, leading to non-firing of the charge in the respective cylinder. This is a common ailment in aviation engines using leaded fuel, especially during taxiing operations and initial take-off when the engine may not have reached design operating temperatures. Further, polyetheramines are known in combustion additive formulations and this is an expected ingredient.

Advantages over the prior art include, at least, the following: First, removing existing and prevent new deposits in the inlet manifold, from diesel fuel injectors, combustion chambers, piston rings and cylinder heads. Next, lubricating the wetted working parts of the diesel fuel injector pump and extend its life, especially in low sulfur fuels, down to 500 parts per million sulfur by weight mandated in California.

Then, providing a carrier solvent in which the all parts of the formulation are soluble in all proportions and which has the further property of having a flash point below that which is allowed by common carriers and IATA for air shipment. This is because it is not flammable under US DOT 173.120(a)

subsection 2 (not flammable) and IATA regulations for air freight shipping and ground common carrier regulations.

The additive increases the efficiency of the engine by removing and preventing fuel line or combustion deposits from occurring within the engine, makes the fuel flame front speed more uniform, maintains or lowers EPA tailpipe emission levels by maintaining engine combustion chamber cleanliness, inhibits fuel tank organic growth formation and extends fuel pump life.

The carrier solvent has the further property of emulsifying water up to a concentration equal to its own volume, allowing this water to be removed from the fuel supply system and be vaporized and expelled from the engine. It has the further property of acting as an anti-icing additive because it will absorb super cooled dissolved water at temperatures where ice crystals would normally form on adjacent surfaces to the fuel. It is very similar chemically to PRIST used in aviation fuel for that purpose. This provides a diesel fuel additive which can be shipped by common carrier such as UPS or FedEx, meeting IATA air shipment volatility requirements. Also, tricresyl phosphate is an organic material growth inhibitor which prevents organic material growth in the diesel fuel tank and lines. For instance, a user can add less than 2% by volume of a solvent with a flash point greater than 141° Fahrenheit for dissolving at least one member selected from the group consisting of an odorizing additive and an antioxidant additive. For instance, isopropanol, dichlorobenzene, or a combination thereof can be effective. Of those, it can be preferable to use have the tricresyl phosphate include an ortho isomer content of below 3.0 percent by weight.

Next, making the flame front speed of combustion more uniform, effectively increasing the efficiency of the fuel and thus reduce the fuel consumption of an engine using this additive formulation.

These advantages are further explored in the following experiments.

Example 1

Figure 2:
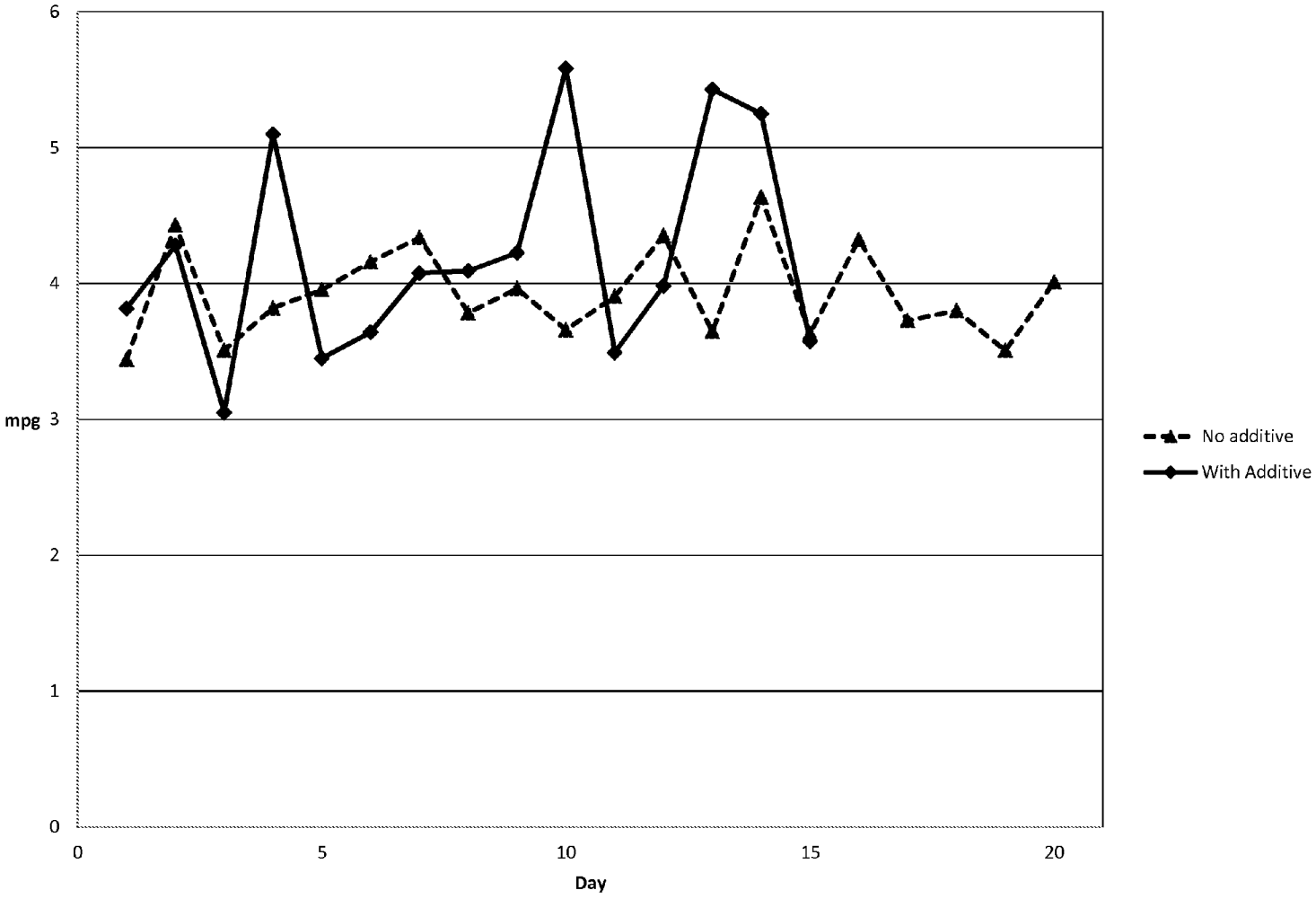
FIG. 2 shows a chart of the results of some experiments of embodiments of the disclosed invention.
Figure 3:
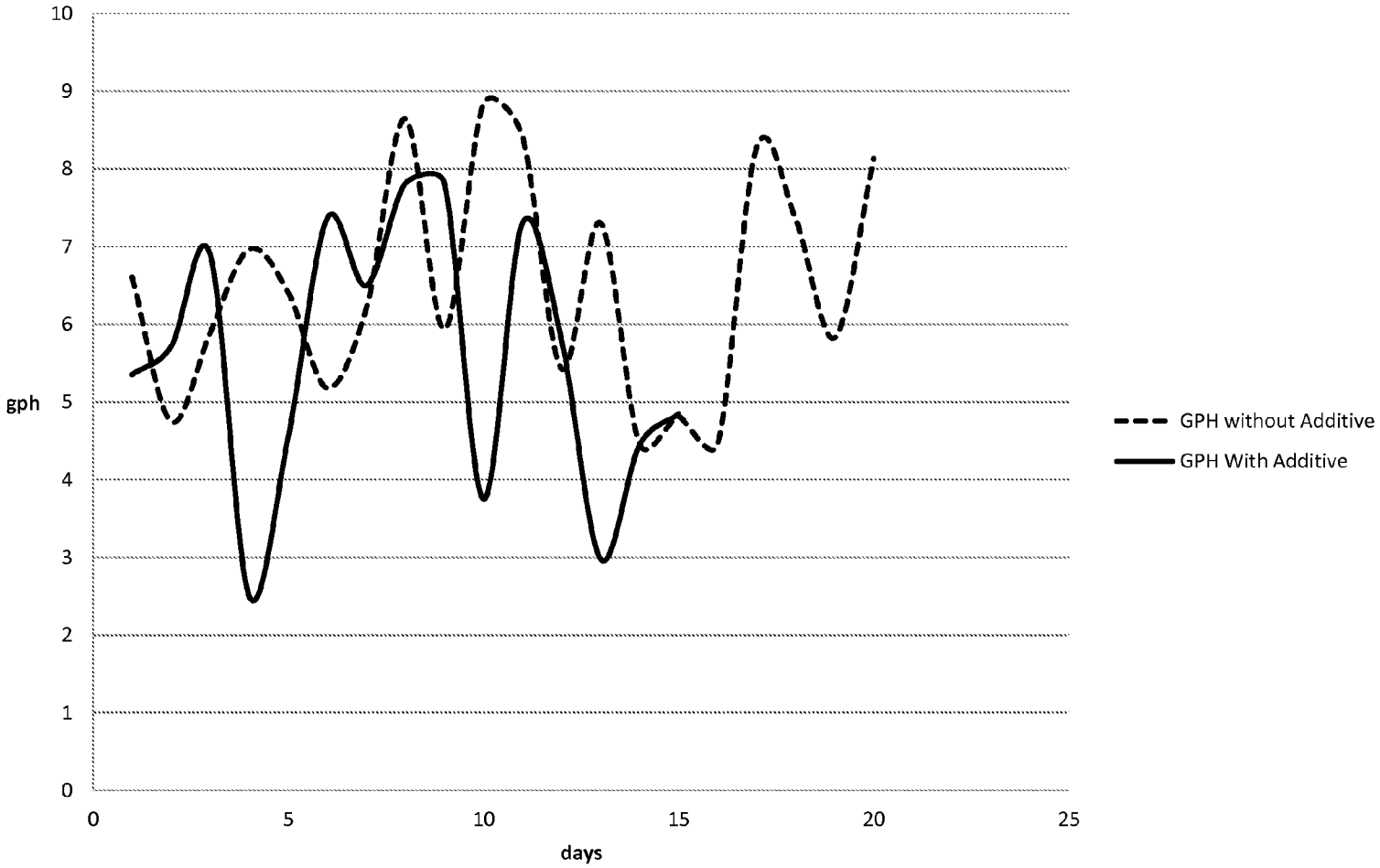
FIG. 3 shows a chart of the results of some experiments of embodiments of the disclosed invention.

Turning to FIG. 2 and FIG. 3, in a controlled Field Test, a Cummins 530 horse power diesel engine in an over the road truck was used. This truck was used by the operator to haul crushed rock daily from a quarry to the point of use, climbing 4,500 feet over a mountain pass from 200 feet elevation to 3,200 feet elevation at the point of unloading. First, data for the operating engine was collected with no additive being used for 21 operating days. Then on the next consecutive operating day the fuel additive was introduced for 15 working days at the rate of one ounce per five gallons of diesel fuel (1.6 ml/liter) every time the truck was fueled.

In a 15 day, three working week test, the truck engine used 14.15% less fuel on a gallons/hour basis and increased miles per gallon by 6.95%. This test was carried out on Summer Grade diesel during September in California. Fuel use was monitored daily and engine hours run were recorded on a daily log sheet. No problems were encountered in engine starting, running or operating. Total miles run in the test were 1,962 while the additive was used.

Example 2

The owner of a 2004 Dodge Ram truck with a 5.9 liter (California) Cummins diesel engine reported a change of fuel usage from 17.0 mpg to 19.0 mpg, an improvement of 11.7%, on a steady run of 250 miles of freeway usage, from San Jose to Redding Calif. on a round trip.

Example 3

The owner of a 2006 Ford F350 4WD with 29,000 miles with 6 liter turbo diesel engine gave the following results. The owner kept meticulous records in a notebook of all mileages and fuel used for ten years for all vehicles he used.

In February 2013 on mostly freeway running, over a distance of 27,450-27,640=190 miles, 12.0 gallons of fuel was added together with 10 ounces of an embodiment of the disclosed additive, giving 15.83 mpg. This test also cured a sticking fuel injector.

Use of an embodiment of the disclosed additive was then discontinued. In the intervening period there were no mechanical or computer processing unit changes made to the engine. The turbocharging pressure was not changed. In July of 2013 over a distance of 27,640-27,920=280 miles 21.0 gallons of fuel was added and no additive, giving 13.33 mpg. From these two data points, there was an improvement of 2.49 miles per gallon or an 18.77% reduction in fuel consumption when the additive was used.

Then the additive was re-introduced; the truck was mostly used in short runs around town. In October 2013 with additive, there was 141 miles of local driving. There was a fuel consumption of 15.16 mpg. This is 13.7% improvement.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A process for increasing efficiency of a diesel engine running on diesel fuel; the process comprising:

adding to the diesel fuel a diesel engine fuel additive mixture further comprising:

2 to 20 percent by volume tricresyl phosphate;

5 to 70 percent by volume polyetheramine; and at least one glycol ether, wherein the polyetheramine comprises a member selected from a group consisting of:

Formula A

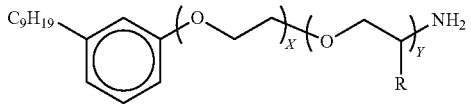

Formula B

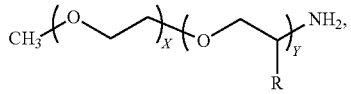

wherein R is selected from the group consisting of H and $CH_3$, wherein y is in a range of 2 to 30 and x is 0 or in a range of 2 to 30 when R is $CH_3$, and wherein x+y is in a range of 2 to 30 when R is H.

2. The process of claim 1, wherein R is $CH_3$ and y is in a range of 2 to 30.

3. The process of claim 1, R is H and x+y is in a range of 2 to 30.

4. The process of claim 1, wherein the glycol ether has a flash point between 141° Fahrenheit and 200° Fahrenheit.

5. The process of claim 1, wherein the glycol ether comprises 2-butoxyethanol.

6. The process of claim 1, wherein the glycol ether comprises a glycol ether or mixture of glycol ether selected from the group consisting of 2-methoxyethanol, 2-ethoxyethanol, 2-propoxyethanol, 2-isopropoxyethanol, 2-butoxyethanol, 2-phenoxyethanol, 2-benzyloxyethanol, 2-(2-methoxyethoxy)ethanol, methyl carbitol, 2-(2-ethoxyethoxy)ethanol, carbitol cellosolve, 2-butoxyethoxyethanol, dimethoxyethane, diethoxyethane, and dibutoxyethane.

7. The process of claim 1, wherein R is CH3, x is in a range of 2 to 30, and y is in a range of 2 to 30.

8. The process of claim 1, wherein the polyetheramine comprises formula A.

9. The process of claim 8, wherein the polyetheramine comprises a phenyl group containing an amine substituent, R is $CH_3$, x is in a range of 2 to 30, and y is in a range of 2 to 30.

10. The process of claim 1, wherein the polyetheramine has a molecular weight in a range of 800 to 2,500.

11. The process of claim 1, wherein the diesel engine fuel additive mixture further comprises 0.5 percent by weight or less of a dye.

12. The process of claim 1, wherein the diesel engine fuel additive mixture further comprises less than 0.5 percent by weight of an antioxidant.

13. The process of claim 1, wherein the diesel engine fuel additive mixture further comprises less than 0.15 percent by weight odorizing additive.

14. The process of claim 1, wherein the diesel engine fuel additive mixture further comprises up to 2 percent by volume of a solvent having a flash point above 141° Fahrenheit for dissolving at least one member selected from the group consisting of an odorizing additive and an antioxidant additive.

15. The process of claim 14, wherein the solvent comprises isopropanol, dichlorobenzene, or a combination thereof.

16. The process of claim 15, wherein the tricresyl phosphate includes an ortho isomer content of below 3.0 percent by weight.

17. A diesel engine fuel additive mixture configured to increase efficiency of a diesel engine running on diesel fuel; the diesel engine fuel additive mixture, comprising:

2 to 20 percent by volume tricresyl phosphate;

5 to 70 percent by volume polyetheramine; and at least one glycol ether, wherein the polyetheramine comprises a member selected from a group consisting of:

Formula A

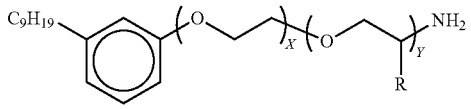

Formula B

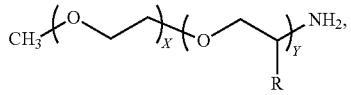

wherein R is selected from the group consisting of H and $CH_3$, wherein y is in a range of 2 to 30 and x is 0 or in a range of 2 to 30 when R is $CH_3$, and wherein x+y is in a range of 2 to 30 when R is H.

18. The diesel engine fuel additive mixture of claim 17, wherein R is $CH_3$ and y is in a range of 2 to 30.

19. The diesel engine fuel additive mixture of claim 17, R is H and x+y is in a range of 2 to 30.

20. The diesel engine fuel additive mixture of claim 17, wherein the glycol ether has a flash point between 141° Fahrenheit and 200° Fahrenheit.

* * * * *